United States Patent [19]

Hopkins et al.

[11] 4,261,517

[45] Apr. 14, 1981

[54] ATOMIZING AIR METERING NOZZLE

[75] Inventors: Edward P. Hopkins, East Berne; Neil S. Rasmussen, Schenectady, both of, NY

[73] Assignee: General Electric Company, Schenectady, N.Y.

[21] Appl. No.: 96,782

[22] Filed: Nov. 23, 1979

[51] Int. Cl.[3] ..... B05B 7/10

[52] U.S. Cl. ..... 239/406

[58] Field of Search ..... 60/740, 748; 239/405, 239/406

[56] References Cited

U.S. PATENT DOCUMENTS

| | | | |
|---|---|---|---|
| 3,474,970 | 10/1969 | Simmons et al. | 239/406 X |
| 3,887,135 | 6/1975 | Tamai | 239/406 |
| 3,979,069 | 9/1976 | Garofalo | 239/406 X |
| 4,116,388 | 9/1978 | Trozzi | 239/406 |

*Primary Examiner*—Andres Kashnikow
*Attorney, Agent, or Firm*—Jerome C. Squillaro

[57] ABSTRACT

A nozzle is provided for a gas turbine combustion system in which the atomizing air metering nozzle is provided with an aerodynamically rotating orifice which turns air flow radially inward toward the source of oil or other liquid fuel prior to initiating a swirling vortex to eliminate centrifuging action of the air stream within the nozzle. Metering on the atomizing air vortex generating vanes are located at the exit of the vanes near the outer face of the fuel nozzle to eliminate entrapment of airborne particles. Vortex generator vanes are provided in the air stream path; these vanes lie on the surface of a cone which converges toward the nozzle exit. The vanes are at an angle to lines which would lie in a plane through the axis of the aforementioned cone along the surface of the cone, thereby to form a swirling air vortex at the nozzle exit.

3 Claims, 11 Drawing Figures

ATOMIZING AIR METERING NOZZLE

BACKGROUND OF THE INVENTION

This invention relates to nozzles for gas turbine combustion systems and more specifically relates to a novel atomizing air metering nozzle using an aerodynamically rotating orifice having improved erosion resistance performance in dual fuel and oil-only air atomized fuel nozzles.

Nozzles are well known for atomizing liquid fuels with air for efficient combustion for use in connection with gas turbine systems. In one known nozzle arrangement, a fuel such as oil is sprayed through an interior opening and is atomized by an air flow which intercepts the oil supply. Natural gas or a low BTU fuel, such as coal-derived gases, may also be used in these dual fuel nozzles, such as disclosed in copending application Ser. No. 018,932 filed Mar. 3, 1979 in the names of Robert A. Battista and William A. Hibbins and entitled "Low BTU Fuel Nozzle."

It has been found that there is excessive erosion on the atomizing air side of such nozzles. This erosion is caused by the entrapment of airborne particles in a highly rotating atomizing air path around the inside wall of the outer fuel nozzle tip. This causes erosion through the outer fuel nozzle tip outer wall to the gas side of the nozzle.

The rate of erosion in these prior art nozzles is significantly increased when using a higher atomizing air pressure ratio which increases the spinning and centrifugal forces on heavier particles. This erosion problem makes frequent inspection and replacement of parts necessary in order to prevent possible hazardous conditions.

BRIEF DESCRIPTION OF THE PRESENT INVENTION

The present invention provides a novel aerodynamically rotating orifice for the atomizing air metering nozzle of a gas turbine combustion nozzle. The novel aerodynamically rotating orifice arrangement contains vanes which define a vortex air flow on the output side of the nozzle after the air flow has been turned radially inward. By turning the air flow radially inward prior to initiating the swirling vortex, it is possible to substantially eliminate the centrifuging action of the air stream inside the nozzle. Further, by having the metering of the atomizing air side located at the air exit and near the face of the fuel nozzle, it is possible to eliminate a low air velocity region in the nozzle which can trap airborne particles before they reach the higher velocity metering sections. The air velocity is then gradually increased to the metering exit plane of the slots by the novel design of the vortex generator vanes which are disposed on the axis of a converging cone but are angularly displaced over the cone surface from the cone axis.

The novel aerodynamically rotating orifice substantially reduces fuel nozzle erosion in gas turbines and substantially increases the lifetime of the associated parts. The novel nozzle of the invention has exhibited the following advantages:

1. The nozzle eliminates the entrapment of airborne particles.

2. The novel nozzle has an improved spray quality and uniformity.

3. The novel nozzle maintains low levels of combustion resonance.

4. The gas exit temperature profile is virtually identical to that of prior nozzles.

5. It has been found that the combustion liner skin temperatures have been reduced when using the nozzle of the invention.

6. The use of the nozzle of the present invention does not increase emission levels.

7. It has been found that smoke levels at lower atomizing air ratios, for example 1.4:1 for both number 2 and number 6 fuels is reduced when using the novel nozzle.

DETAILED DESCRIPTION OF THE DRAWINGS

Figure 1:
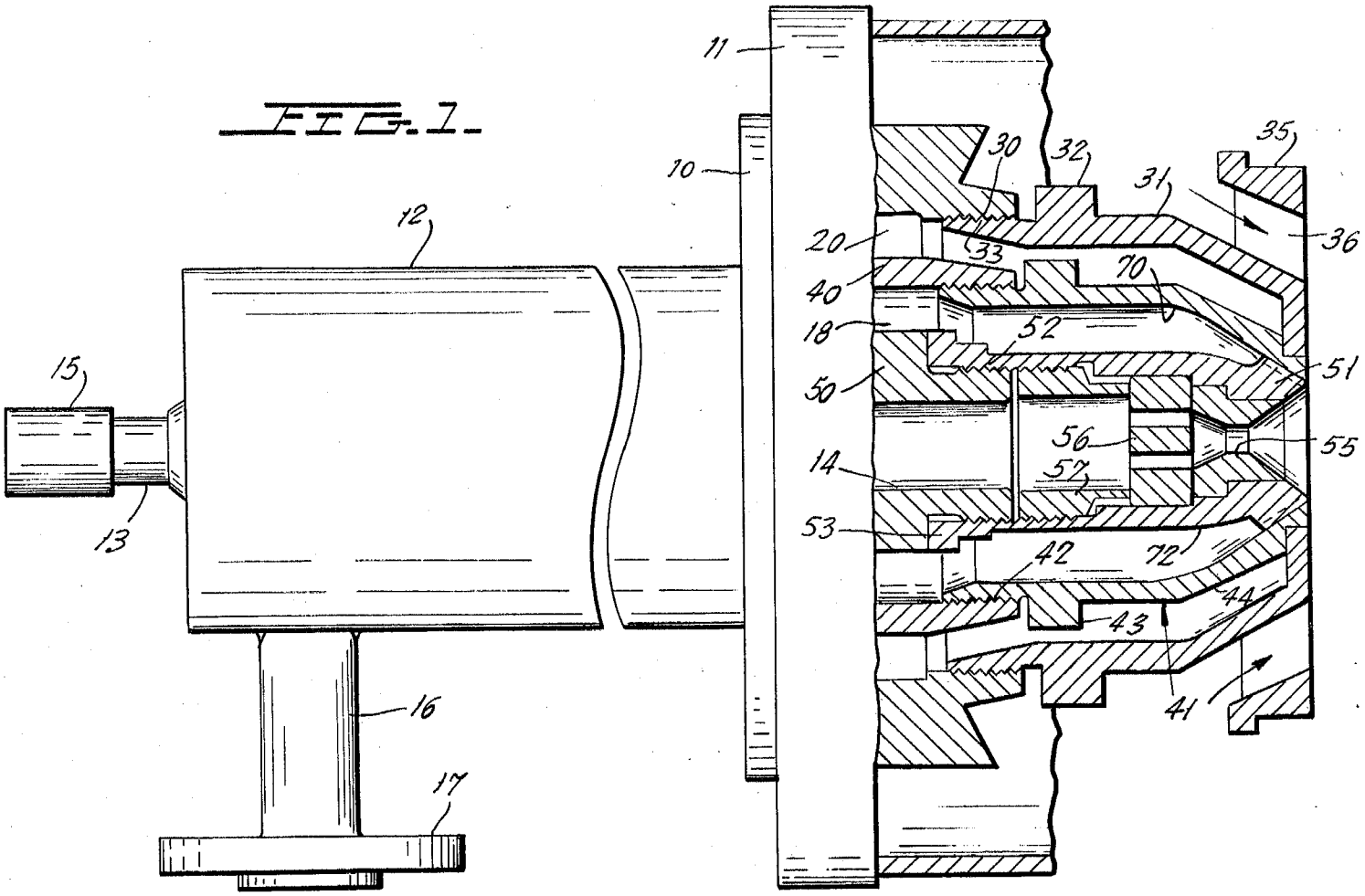
FIG. 1 is a plan view partially in section showing the novel nozzle of the present invention.
Figure 2:
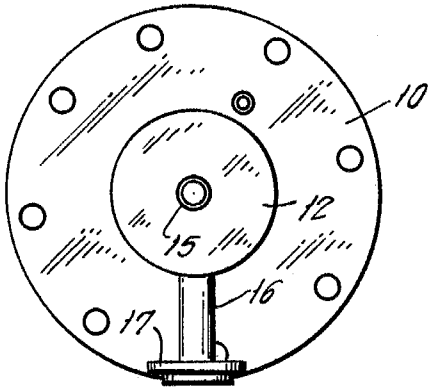
FIG. 2 is a plan view of the left-hand end of FIG. 1 shown in substantially reduced scale.

Referring first to FIGS. 1 and 2, there is shown a conventional nozzle body 10 which is connected to a conventional combustor can 11 of a gas turbine. The nozzle 10 has an extending region 12 which receives the various fluid conduits including a fuel oil conduit 13 having a central opening 14 shown in the sectional portion of FIG. 1, with the conduit 13 having a suitable fuel oil connector 15 connected thereto. Body 12 also includes a conduit 16 which is connected to a source of atomizing air at an atomizing air connection flange 17 which is conventional.

The air applied to the conduit 16 is ultimately applied to the annular channel 18 shown in the sectional portion of FIG. 1. If desired, further conduits can be contained within body 12 including a conduit which might provide a natural gas or a low BTU fuel to the outer channel 20 shown in section in FIG. 1 and in above-noted copending application Ser. No. 018,932. Note that the channels 14, 18 and 20 are shown in FIG. 11 as well as in FIG. 1.

The nozzle body 10 is provided with an internal thread region 30 which threadably receives an annular cylindrical member 31 which aids in defining the channel 20 when natural gas or a low BTU fuel is to be added to the fuel used for the nozzle. FIG. 11 clearly shows the thread 33 on a member 32 which threadably engages thread 30 of nozzle 10 although member 32 is only schematically illustrated in FIG. 11.

Figure 11:
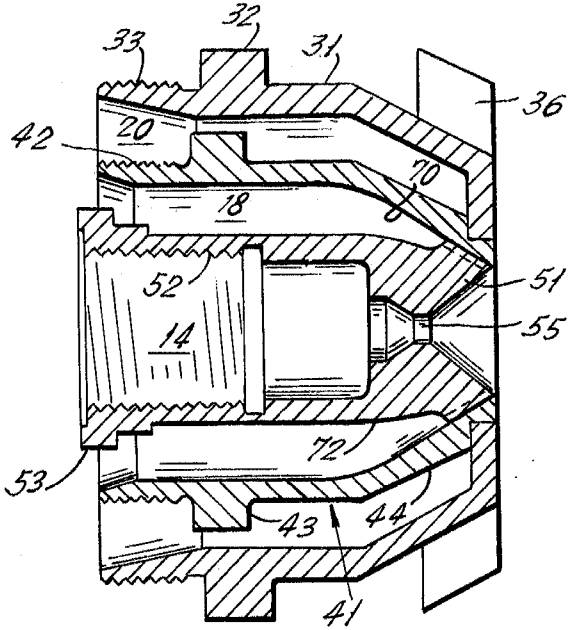
FIG. 11 is an enlarged cross-sectional view showing the subassembly of the inner fuel nozzle tip and outer fuel nozzle tip of FIGS. 1, 4, 6, 9 and 10.

It will also be noted in FIGS. 1 and 11 that the outer member 31 also has secured thereto a swirl plate 35 which defines channels such as channel 36 which permits compressor discharge air flow into the combustion chamber in the known manner.

Figure 4:
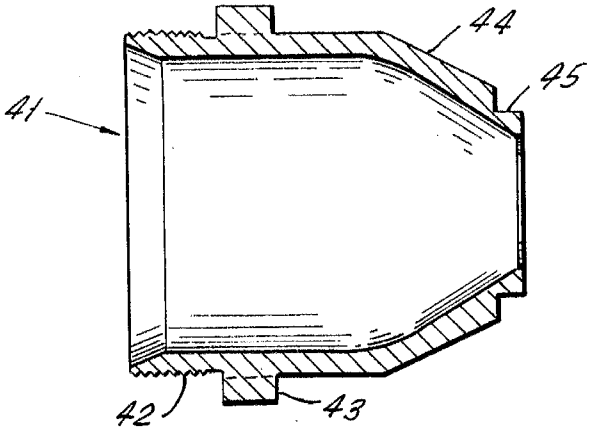
FIG. 4 is a cross-sectional view of FIG. 3 taken across the section lines 4—4 in FIG. 3.
Figure 3:
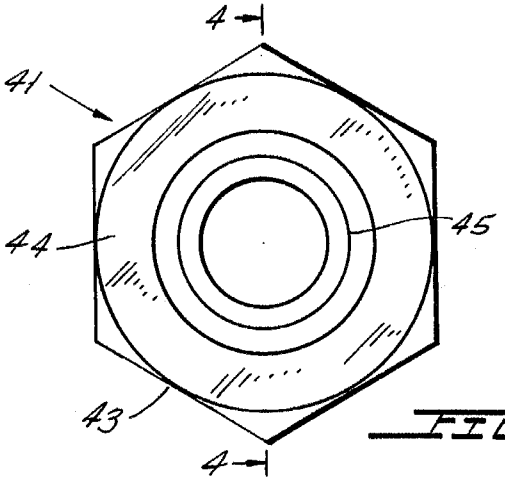
FIG. 3 is an end view of the outer fuel nozzle tip of FIG. 1.

Nozzle 10 of FIG. 1 is also provided with an extending member 40 which threadably receives an outer fuel nozzle tip 41 which is shown, for example, in FIGS. 3 and 4 in further detail. As seen in FIGS. 1, 3 and 4 as well as FIG. 11, the outer fuel nozzle tip 41 is a high strength steel member having a generally cylindrical shape and having a threaded end 42 which is threadably engaged in member 40. The outer fuel nozzle tip 41 has a hexagonal section 43, for example, to enable tightening by conventional tools when assembling the nozzle. Tip 41 also has an inwardly converging section 44, the exterior of which aids in defining the channel 20 of FIG. 1. The outer end of the nozzle tip 41 has a shoulder 45, shown in FIGS. 3 and 4, which receives the inwardly projecting flange sections of member 31 as seen in FIGS. 1 and 11.

Figure 5:
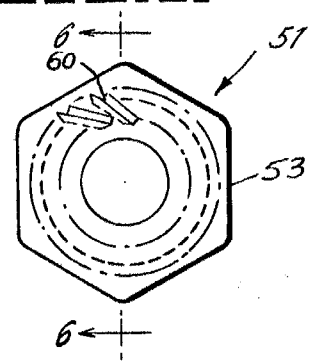
FIG. 5 is an end view of the inner fuel nozzle tip of FIG. 1.
Figure 6:
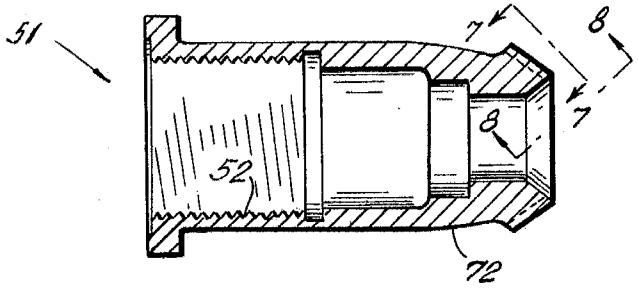
FIG. 6 is a cross-sectional view of FIG. 5 taken across the section line 6—6 in FIG. 5.

A further extension 50 is provided on the nozzle body 10 and has an outer threaded surface which threadably receives an inner fuel nozzle tip 51. As best shown in FIGS. 5, 6 and 11, the inner fuel nozzle tip 51 has an outer hexagonal section 53 and an inner thread 52 which threadably receives the supports extension 50. The interior of nozzle tip 51 is further provided with suitable means for receiving oil spray control members 55 and 56 (FIG. 1) which are held in place by a lock member 57 and cause initial atomization of the oil as it leaves the restricted nozzle control member 55.

Figure 10:
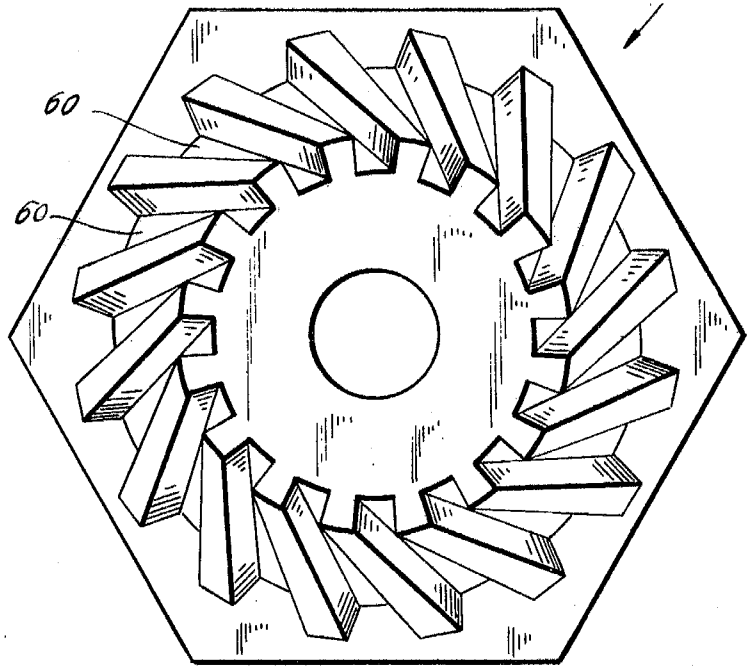
FIG. 10 is a view of the right-hand side of FIG. 9 and further illustrates the configuration of the vanes.
Figure 9:
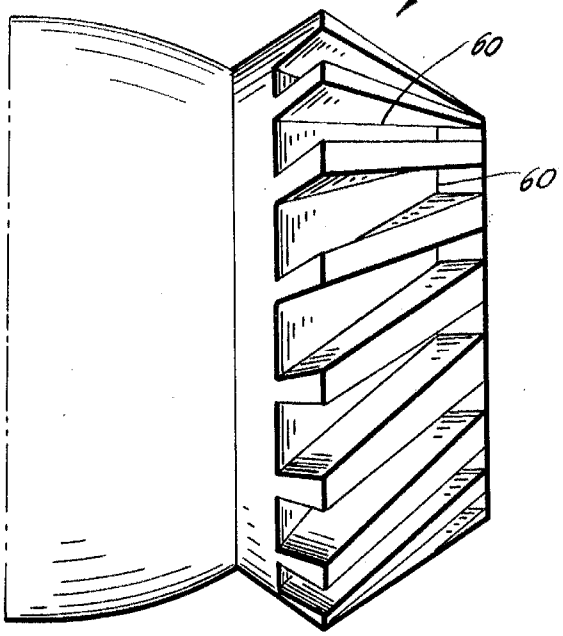
FIG. 9 is an elevational view of the novel vane structure of the inner fuel nozzle tip of FIG. 6 and better illustrates the manner in which the vanes define the inwardly turned and whirling vortex for the fuel nozzle.

In accordance with the invention, the right-hand end of the inner nozzle tip 51 is provided with a plurality of slots 60, typically sixteen slots, which are arranged on the surface of a cone and which are at a skewed angle to the axis of the cone. A few slots 60 are shown in FIG. 5 but these slots extend completely around the outer surface of the inner tip 51 as is best shown in FIGS. 9 and 10.

Figure 7:
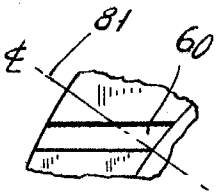
FIG. 7 is a view of one of the metering vanes in the inner fuel nozzle tip as seen from the line 7—7 in FIG. 6.
Figure 8:
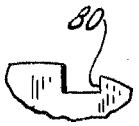
FIG. 8 is a cross-sectional view of FIG. 6 taken across the section line 8—8 in FIG. 6.

It can be seen from FIG. 7 that the plurality of slots 60 taper inwardly and at a skew angle to the center line 81 of the cone containing the slots so that a vortex action is imparted to the air flowing from the channel 18, shown in FIGS. 1 and 11. Typically, the slots 60 will have an angle of about 36° to a line formed on the surface of the cone by a plane containing the line and the center line 81 of the cone. This has been referred to herein as a skew angle between the cone axis and the slot. As pointed out above, typically sixteen slots may be used, each having a width of about 0.100 inch equally spaced from one another. The slot depth may typically be about 0.128 inch. The outer diameter of the slots measured at their largest diameter point may be about 1.5 inches. As illustrated in FIGS. 9 and 10, the cross-sectional area of the slots 60 is less at the discharge end than at the inlet end. This decrease in area causes acceleration at the air flowing therethrough, thereby preventing airborne particles from being trapped in the nozzle.

FIGS. 1 and 7 illustrate that prior to the time the vortex is initiated, the air in channel 18 is directed inwardly by the inwardly turned annular region 70 between the outer tip 41 and the inner tip 51. That is, the outer surface of inner tip 51 has a radius section 72 as seen in FIGS. 1, 6 and 11 which, in cooperation with the inwardly turned interior surface of member 41, forms an annulus so that air flow is caused to converge toward the nozzle output before it reaches the vortex section formed by the pluarlity of slots 60. It should be noted that the converging slots 60, illustrated in FIGS. 9 and 10 accelerate the air flow to the metering at the exit of the nozzle and the vanes define the inwardly turned and whirling vortex for the fuel nozzle.

The nozzle structure of the invention, which is characterized by the arrangement of the inner and outer nozzle tips 41 and 51, respectively, could, of course, be carried out by many different mechanical configurations. One of the essential features of the present invention is that the flow of the atomizing air is initially caused to turn inwardly and is then caused to turn in a vortex pattern by the angular skewing of the slots in the nozzle and is accelerated in the slots 60 by the decreasing cross-sectional area of the slots as the atomizing air approaches the fuel oil emerging from the center of the nozzle.

By turning the air flow radially inward in the region 70 prior to initiating the swirling vortex, it is possible to eliminate centrifugal action of the air stream inside of the nozzle and thus the abrasive action of airborne particles in the nozzle interior. Secondly, the metering on the atomizing air side of the nozzle is at the exit of the nozzle and near the face of the fuel nozzle. This arrangement eliminates the possible trapping of airborne particles between a low velocity region and the higher velocity metering sections. The air velocity is then gradually increased to the metering exit plane at the end of the nozzle slots 60 by the configuration of the vortex generator vanes.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A fuel nozzle structure for introducing atomized fuel into a gas turbine combustor, said fuel nozzle structure comprising:

a nozzle body including a liquid fuel supply conduit extending along the body axis, said conduit having a fuel outlet end for ejecting fuel therefrom;

an annular channel concentrically surrounding said fuel supply conduit for conveying atomized air to atomize fuel from said fuel outlet end, said channel formed by inner and outer concentric fuel nozzle tips spaced from each other, said inner or outer nozzle tips having a plurality of vortex vanes at one end thereof to define a plurality of equally spaced elongated discharge openings disposed adjacent said fuel outlet end, said discharge openings converging inwardly toward said fuel outlet end and being skewed in a direction to define a rotating air vortex about the axis of said body;

said inner and outer nozzle tips having radial inwardly directed portions leading to said elongated discharge openings for causing air flow in said annual channel to turn inwardly without rotation about said axis before passing through said discharge openings, the turning of air flow radially inward prior to rotation eliminating centrifugal action of the airflow and thereby reducing abrasive action of airborne particles on the nozzle structure and further eliminating the possible trapping of airborne particles between a low velocity region and a higher velocity region of said nozzle structure.

2. The fuel nozzle of claim 1 wherein said plurality of vortex vanes are arranged on the surface of said inner nozzle tip of conical shape with spaces between said vanes defining a plurality of slots.

3. The fuel nozzle of claim 2 wherein the crosssectional area of said slots is less adjacent said fuel outlet end than at the inlet end thereof thereby causing acceleration of the air flowing there-through.

* * * * *